US006413191B1

(12) United States Patent
Harris et al.

(10) Patent No.: US 6,413,191 B1
(45) Date of Patent: Jul. 2, 2002

(54) EXERCISE EQUIPMENT CONNECTED TO AN ELECTRONIC GAME OF CHANCE

(75) Inventors: Kathy M. Harris, Oakton; Charles W. True, III, Vianna, both of VA (US)

(73) Assignee: Fitness Gaming Corporation, Fairfax, VA (US)

( * ) Notice: Subject to any disclaimer, the term of this patent is extended or adjusted under 35 U.S.C. 154(b) by 0 days.

(21) Appl. No.: 09/385,463

(22) Filed: Aug. 30, 1999

Related U.S. Application Data

(63) Continuation-in-part of application No. 09/009,311, filed on Jan. 20, 1999, now abandoned.
(60) Provisional application No. 60/101,552, filed on Sep. 22, 1998.

(51) Int. Cl.[7] ..... A63B 71/00
(52) U.S. Cl. ..... 482/8; 482/3; 482/9; 482/57; 482/902; 273/138.1
(58) Field of Search ..... 482/1–9, 51–54, 482/57, 72, 900–902; 463/16, 23, 25; 273/138.1, 139, 142 R

(56) References Cited

U.S. PATENT DOCUMENTS

| | | | | |
|---|---|---|---|---|
| 4,542,897 A | | 9/1985 | Melton et al. | |
| 5,240,417 A | * | 8/1993 | Smithson et al. | 434/61 |
| 5,362,069 A | | 11/1994 | Hall-Tipping | |
| 5,505,457 A | | 4/1996 | Boylan et al. | |
| 5,645,513 A | | 7/1997 | Haydocy et al. | |

* cited by examiner

*Primary Examiner*—Glenn E. Richman
(74) *Attorney, Agent, or Firm*—Finnegan, Henderson, Farabow, Garrett & Dunner, LLP

(57) ABSTRACT

A piece of exercise equipment includes an electronic game of chance connected thereto. A switch or other device may also be connected to the combination system to operate the electronic game of change when the piece of exercise equipment is in use. The combination system also includes a controller which detects a combined action of playing the electronic game of chance and using the exercise equipment. The system electronically connects the gambling device to the piece of exercise equipment and detects when an operator is using both the exercise equipment and the electronic game of chance simultaneously.

9 Claims, 3 Drawing Sheets

EXERCISE EQUIPMENT CONNECTED TO AN ELECTRONIC GAME OF CHANCE

RELATED APPLICATIONS

This application is a Continuation-In-Part application of Ser. No. 09/009,311, now abandoned, filed on Jan. 20, 1998. This application also claims priority based on provisional application Ser. No. 60/101,552 filed on Sep. 22, 1998.

FIELD OF THE INVENTION

The present invention is directed to the combination of an electronic game of chance device and a piece of exercise equipment.

BACKGROUND OF THE INVENTION

Legalized gambling establishments are becoming more and more prominent worldwide. Electronic games of chance, such as electronic slot machines, are one of the most widely used games at these establishments. Players often spend hours running one or more machine, continuously attempting to beat the odds.

Today's more health-conscience individuals enjoy working out as part of their leisure time. Individuals using exercise equipment, such as stationary bikes, treadmills, or stair climbers, often look for alternative means to occupy their time while completing mundane workouts. It is not unusual to see individuals on such equipment reading, watching television, or listening to the radio to pass time.

Accordingly, it is object of the invention to combine a piece of exercise equipment with an electronic game of chance.

SUMMARY OF THE INVENTION

The present invention offers a unique source of entertainment for individuals working out, and from the perspective of the casino owners, offers a new locale to promote their legal gambling services.

To achieve these and other advantages and in accordance with the purposes of the invention, as embodied and broadly described, the invention includes a system comprising a piece of exercise equipment, an electronic game of chance device connected to the piece of exercise equipment, means for initiating the system, and means for operating the system when the electronic game of chance device and the piece of exercise equipment are being used simultaneously.

To achieve these and other advantages, and in accordance with the purposes of the invention, the invention also includes a control circuit for detecting a simultaneous use of an exercise equipment connected to an electronic game of chance device. The control circuit comprises an exercise equipment detecting circuit and to detect whether the exercise equipment is being used, and an electronic game of chance detecting circuit to detect whether the electronic game of chance device is being played. The electronic game of chance detecting circuit is being electronically connected to the electronic game of chance detecting circuit. During a predetermined period of time, the exercise equipment and the electronic game of chance device operate when they are being used simultaneously.

To achieve these and other advantages, and in accordance with the purposes of the invention, the invention further includes a combination device comprising a piece of exercise equipment, an electronic game of chance device connected to the exercise equipment, an initiation detecting circuit to initiate the combination device when an initiation signal is received, an exercise equipment detecting circuit to detect when the exercise equipment is being used, and an electronic game of chance detecting circuit to detect when the electronic game of chance is being played. The electronic game of chance detecting circuit is being electronically connected to the exercise equipment detecting circuit. During a predetermined period of time, the combination device operates when the exercise equipment is being used and, simultaneously, the electronic game of chance is being played.

To achieve these and other advantages, and in accordance with the purposes of the invention, the invention yet further includes a method for operating a combination machine of an exercise equipment connected to an electronic game of chance. The method comprises the steps of initiating the electronic game of chance device, and using the exercise equipment and playing the electronic game of chance device for a predetermined period of time. At the end of the predetermined period of time, the combination machine shuts down when the exercise equipment and the electronic game of chance device are not being simultaneously used.

Finally, to achieve these and other advantages, and in accordance with the purposes of the invention, the invention includes a method for making a combination machine including an exercise equipment and electronic game of chance device. The method comprises the steps of providing initiation means to initiate the combination machine, connecting the exercise equipment to an exercise equipment detecting circuit, the detecting circuit outputting an exercise-on signal when the exercise equipment is being used, connecting the electronic game of chance device to an electronic game of chance detecting circuit, the detecting circuit outputting a game-on signal on when the electronic game of chance device is being played, and providing an exercise/game control circuit to receive the exercise-on signal and the game-on signal, the exercise/game control circuit allowing the combination machine to operate when exercise-on signal and game-on signal are simultaneously received during a predetermined period of time.

DETAILED DESCRIPTION OF THE INVENTION

Reference will now be made in detail for the construction and operation of preferred implementations of the present invention which are illustrated in the accompanying drawing.

The following description of the preferred implementation of the invention is only exemplary of the invention. The present invention is not limited to these implementations, but may be realized by other implementations.

Each game of chance incorporates its own method of accepting a wager from the player. Several methods of accepting the wager are currently available in the industry, for example, insertion of a coin or token, acceptance and verification of a piece of paper currency, or decoding and debiting a balance of a credit or debit card.

Figure 1:
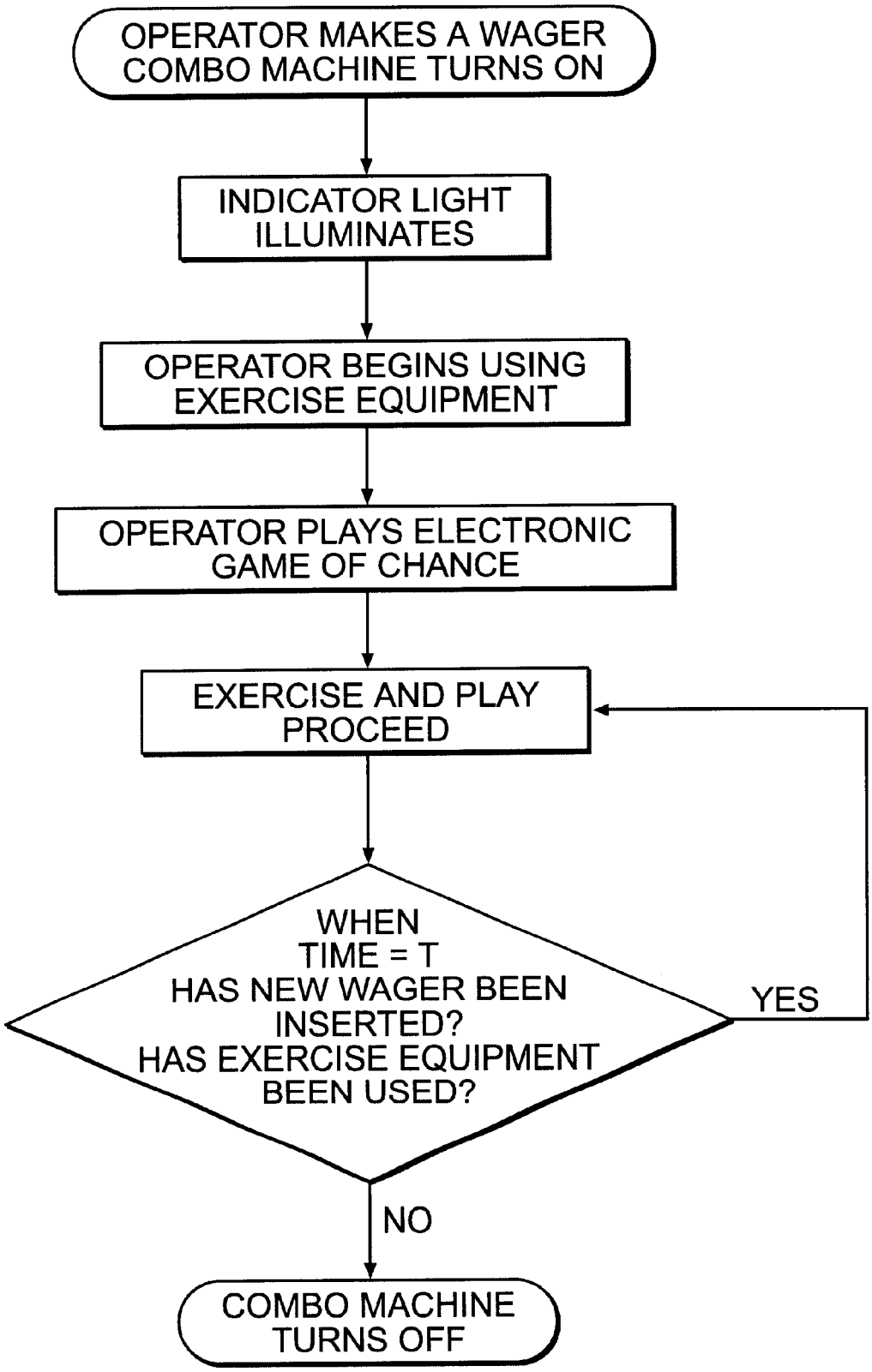
FIG. 1 is a schematic diagram illustrating the interaction between an operator and the system according to the present invention.

FIG. 1 illustrates the interaction between an operator and a combination of an exercise equipment and an electronic game of chance. The combo machine starts when the operator makes a wager. An indicator, such as a "Coin Accepted" light, illuminates. The operator then begins to use the exercise equipment, including programming the device to adjust speed and difficulty settings, etc. The operator then "plays" the electronic game of chance. Play and exercise will continue. If a predetermined delay expires without a new wager being made, the exercise equipment will shut down. Likewise, if the operator does not use the exercise equipment while playing the electronic game of chance, the combo machine will not allow the operator to play.

Figure 2:
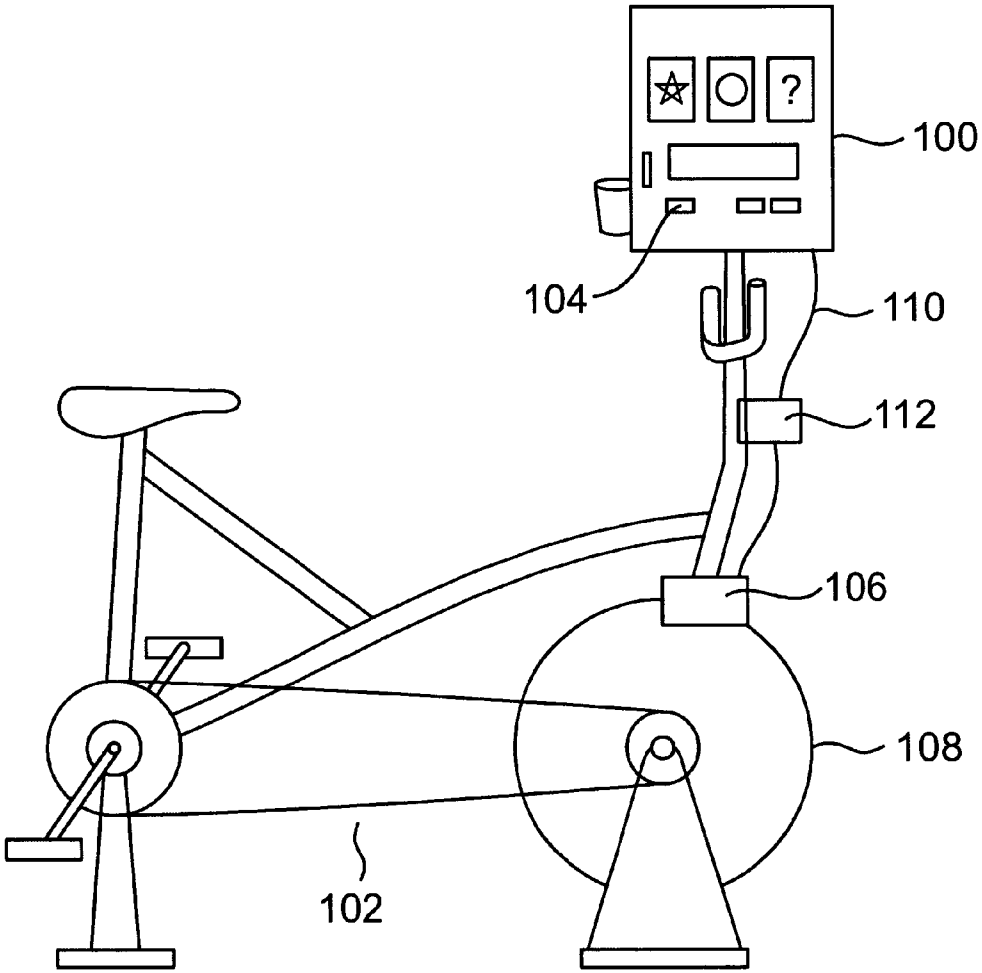
FIG. 2 is a drawing of an exercise bicycle with an electronic game of chance in accordance with one embodiment of the present invention.

FIG. 2 shows one embodiment of the invention. As shown, an electronic game of chance 100, such as electronic slot machines, is positioned on and electronically coupled to a stationary bicycle 102. Electronic games of chance are available from various manufacturers, and the present invention includes the use of any such devices. The electronic game of chance 100 in accordance with the present invention may include any type of self-contained system or a user terminal which connects directly or remotely to a larger system.

Although FIG. 2 shows a stationary bike 102 as the preferred piece of exercise equipment, in accordance with the present invention, any piece of exercise equipment, which does not typically or fully occupy a user's hands, may be used, for example, treadmills, stair climbers, or other common exercise equipment.

In accordance with an embodiment of the present invention, the electronic game of chance 100 may be modified such that it cannot be turned on unless the exercise equipment is being operated. Although electronic games of chance include an on/off switch 104, in accordance with one embodiment of the present invention, an additional switching mechanism 106 is added such that the on/off switch 104 cannot turn on the electronic game of chance unless the exercise equipment 102 is being used. For example, a switching mechanism 106 may be associated with the flywheel 108 of the stationary bike 102. The switching mechanism 106 may comprise any type of well-known electro-optical, electromagnetic, or electromechanical device for sensing rotation of the flywheel 108 and sending a signal to the electronic game of chance 100 via connection 110 to enable its on/off switch 104. This control configuration discourages individuals from tying up the electronic game of chance 100 without using the exercise equipment 102. In other embodiments, the switching mechanism 106 may be used to detect movement of a treadmill, the stairs of a stairmaster, or any corresponding drive mechanism to initiate the associated electronic game of chance 100.

In accordance with the present invention, for embodiments incorporating such on/off control, control circuitry 112, such as a microprocessor or timing circuitry, may be included to dictate the length of time the exercise equipment 102 must be running before the electronic game of chance 100 will be enabled, to turn off the electronic game of chance 100 after a user completes a workout, and to reinitialize the electronic game of change 100. The electronic circuitry 112 may be embedded within the electronic game of chance or connected to it as an external circuit as shown.

Further in accordance with the present invention, control circuitry 112 includes an Exercise/Game Controller which detects simultaneous use of electronic game of chance devices and exercise equipment components of the system. Both components are preferably active for the system to operate.

Figure 3:
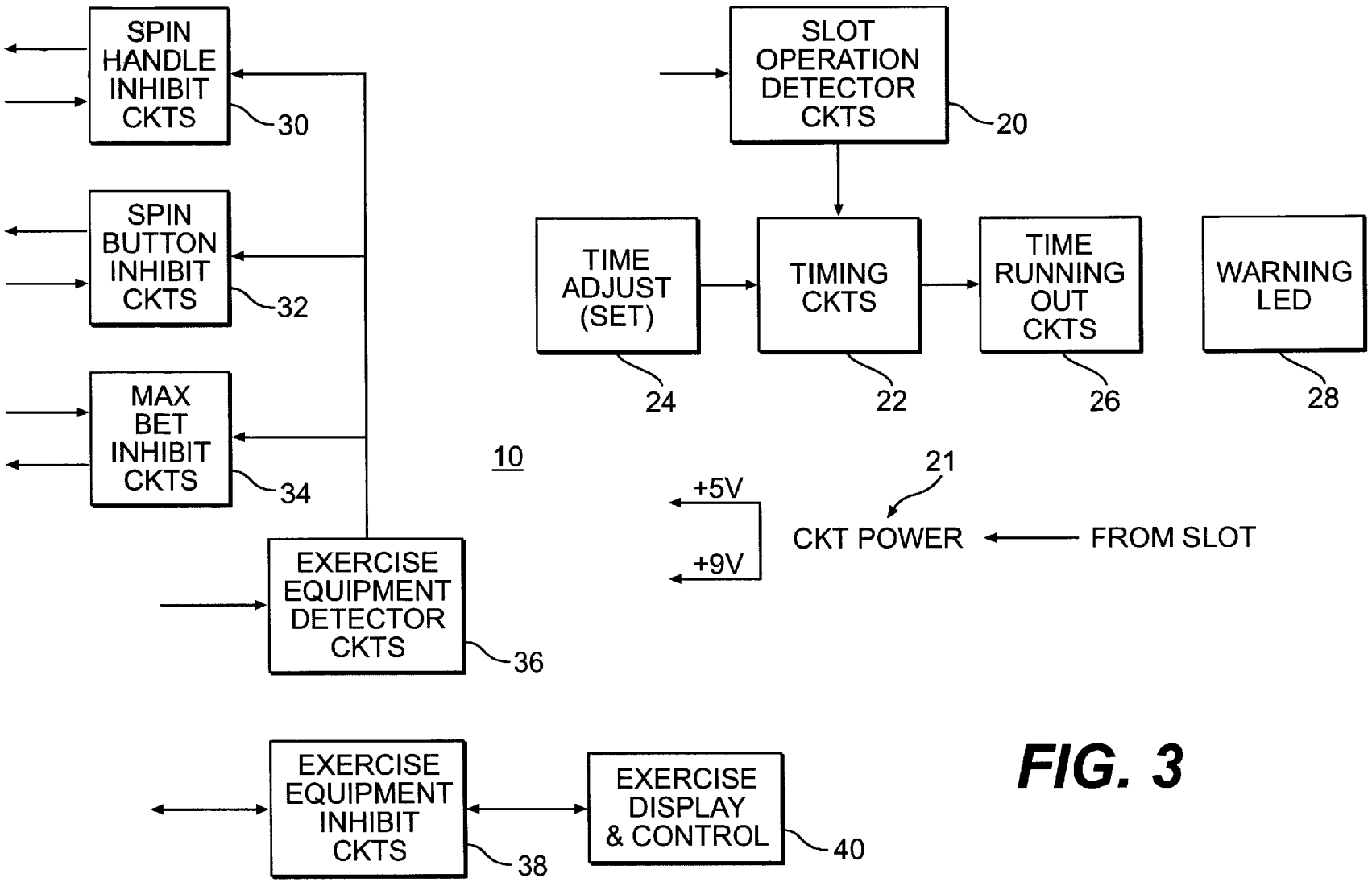
FIG. 3 is a schematic diagram illustrating the components of an Exercise/Game Controller according to the present invention.

In the embodiment illustrated in FIG. 3, an Exercise/Game Control circuit 10 enables and controls the interaction between the machine and the operator. The machine is preferably a combination of a piece of exercise equipment connected with an electronic game of chance. When the operator (not shown) makes a wager, slot operation detector circuits 20 detect the presence of such wager. Circuit 10 subsequently turns on an indicator, such as "Coin Accepted" (not shown). Circuit 10 then activates circuit power 21 and sends electricity, for example 5V and 9V, to power the machine.

Slot operation detector circuits 20 then enable timing circuits 22, for instance by generating a signal to indicate that the machine has received a wager. Timing circuits 22 receive the signal and generate a corresponding output to start clocking a set period of time. The operator may also program his or her desired exercise setting by inputting information into a time adjust circuit 24, which may adjust the speed or level of difficulty of the exercise machine. Based on outputs from timing circuits 22 and time adjust circuit 24, time running out circuits 26 generate a corresponding signal indicating the operating period and mode of the machine. When the period set by time running out circuits 26 is almost ending, a warning LED 28 may be provided to inform the player.

The operator may then start playing the electronic game of chance, i.e. a legalized gambling device. The gambling device (not shown) has several terminals which may take input from the operator and may provide output in response to a corresponding input. These terminals may include spin handle inhibit circuits 30, spin button inhibit circuits 32, and maximum bet inhibit circuits 34. When exercise equipment detector circuits 36 detect that the operator is using the exercise equipment, circuits 36 send signals allowing the spin handle inhibit circuits 30, spin button inhibit circuits 32, and maximum bet inhibit circuits 34 to operate. Play and exercise can then proceed simultaneously.

Exercise equipment inhibit circuits 38 operate to receive a signal, for instance, a signal indicating that a predetermined delay is about to expire. Circuits 38 send a corresponding output to an exercise display and control 40 to inform the operator about the expiring period. If the operator does not make a new wager before the predetermined period expires, then timing circuit 22 outputs a signal to shut down the machine. This shut down functionality may, alternatively, be provided by additional control circuits. Likewise, if the exercise equipment inhibit circuits 38 detect that the operator does not use the exercise equipment while using the gambling device, timing circuit 22 outputs another signal to shut down the machine. Alternatively, the exercise display and control 40 may provide a warning signal to the operator before timing circuits 22 shut down the machine. If the operator ignores the warning signal after a predetermined period of time, then timing circuits 22 shut down the machine.

While there has been illustrated and described what are at present considered to be preferred embodiments and methods of the present invention, it will be understood by those skilled in the art that various changes and modifications may be made, and equivalence may be substituted for elements thereof without departing from the true scope of the invention.

In addition, many modifications may be made to adapt a particular element, technique or implementation to the teachings of the present invention without departing from the central scope of the invention. Therefore, it is intended that this invention not be limited to the particular embodiments and methods disclosed herein, but that the invention include all embodiments falling within the scope of the appended claims.

What is claimed is:

1. A system, comprising:

a piece of exercise equipment;

an electronic game of chance device connected to the piece of exercise equipment;

means for initiating the system; and means for operating the system when the electronic game of chance device and the piece of exercise equipment are being used simultaneously.

2. The system of claim 1, wherein the means for initiating the system comprises a wager detecting circuit to detect when a wager is received and to output a wager signal.

3. The system of claim 2, wherein the wager detecting circuit outputs a time signal when a wager is received.

4. The system of claim 3, wherein the means for operating the system comprises:

a power circuit to start the system upon receiving the wager signal from the wager detecting circuit;

a timing circuit to start clocking a predetermined period of time upon receiving the time signal from the wager detecting circuit;

an exercise equipment detecting circuit to detect whether the exercise equipment is being used; and an electronic game of chance detecting circuit to detect whether the electronic game of chance device is being played, the electronic game of chance detecting circuit being electronically connected to the electronic game of chance detecting circuit;

wherein, during the predetermined period of time, the system operates when the exercise equipment is being used and, simultaneously, the electronic game of chance device is being played.

5. A control circuit for detecting a simultaneous use of an exercise equipment connected to an electronic game of chance device, comprising:

an exercise equipment detecting circuit to detect whether the exercise equipment is being used; and an electronic game of chance detecting circuit to detect whether the electronic game of chance device is being played, the electronic game of chance detecting circuit being electronically connected to the electronic game of chance detecting circuit;

wherein, during a predetermined period of time, the exercise equipment and the electronic game of chance device operate when being simultaneously used.

6. The control circuit of claim 5, further comprising:

a wager detecting circuit to output a wager signal and a time signal upon detecting a presence of a wager;

a power circuit to start the exercise equipment and the electronic game of chance device upon receiving the wager signal from the wager detecting circuit; and a timing circuit to start clocking a predetermined period of time upon receiving the time signal from the wager detecting circuit.

7. A combination device, comprising:

a piece of exercise equipment;

an electronic game of chance device connected to the exercise equipment;

an initiation detecting circuit to initiate the combination device when an initiation signal is received;

an exercise equipment detecting circuit to detect when the exercise equipment is being used; and an electronic game of chance detecting circuit to detect when the electronic game of chance is being played, the electronic game of chance detecting circuit being electronically connected to the exercise equipment detecting circuit;

wherein, during a predetermined period of time, the combination device operates when the exercise equipment is being used and, simultaneously, the electronic game of chance is being played.

8. A method for operating a combination machine including an exercise equipment connected to an electronic game of chance device, comprising the steps of:

initiating the electronic game of chance device; and using the exercise equipment and playing the electronic game of chance device for a predetermined period of time;

wherein, at the end of the predetermined period of time, the combination machine shuts down when the exercise equipment and the electronic game of chance device are not being simultaneously used.

9. A method for making a combination machine including an exercise equipment and electronic game of chance device, comprising the steps of:

providing initiation means to initiate the combination machine;

connecting the exercise equipment to an exercise equipment detecting circuit, the detecting circuit outputting an exercise-on signal when the exercise equipment is being used;

connecting the electronic game of chance device to an electronic game of chance detecting circuit, the detecting circuit outputting a game-on signal when the electronic game of chance device is being played; and providing an exercise/game control circuit to receive the exercise-on signal and the game-on signal, the exercise/game control circuit allowing the combination machine to operate when exercise-on signal and game-on signal are simultaneously received during a predetermined period of time.

* * * * *

UNITED STATES PATENT AND TRADEMARK OFFICE

CERTIFICATE OF CORRECTION

PATENT NO. : 6,413,191 B1 
DATED : July 2, 2002
INVENTOR(S) : Kathy M. Harris and Charles W. True, III It is certified that error appears in the above-identified patent and that said Letters Patent is hereby corrected as shown below:

Title page,
Item [75], Inventors, "Vianna" should read -- Vienna --.
Item [57], ABSTRACT,
Line 4, "change" should read -- chance --.

Signed and Sealed this

Twentieth Day of August, 2002

*Attest:*

*Attesting Officer*

JAMES E. ROGAN
*Director of the United States Patent and Trademark Office*